United States Patent [19]

Mayer

[11] 4,141,393

[45] Feb. 27, 1979

[54] SEALABLE FUEL DISPENSING NOZZLE WITH AUTOMATIC LOW-FLOW SHUT-OFF MECHANISM

[75] Inventor: Edward A. Mayer, Newburgh, N.Y.

[73] Assignee: Texaco Inc., New York, N.Y.

[21] Appl. No.: 702,315

[22] Filed: Jul. 2, 1976

[51] Int. Cl.[2] ..... B65B 3/26

[52] U.S. Cl. ..... 141/206; 141/225; 141/226

[58] Field of Search ..... 141/1, 4, 5, 46, 52, 141/59, 93, 97, 128, 198, 206–229, 285, 290, 392, 193, 292; 138/42

[56] References Cited

U.S. PATENT DOCUMENTS

| | | | |
|---|---|---|---|
| 3,771,577 | 11/1973 | Mayer | 141/209 |
| 3,996,977 | 12/1976 | Hansel | 141/285 |

*Primary Examiner*—Houston S. Bell

*Attorney, Agent, or Firm*—Thomas H. Whaley; Carl G. Ries; Robert B. Burns

[57] ABSTRACT

A fuel dispensing nozzle for a closed system holding a volatile fuel. The nozzle is adapted to sealably engage the filler pipe of a fuel tank to avoid passage of fumes to the atmosphere during a fuel transfer operation. The nozzle will automatically discontinue fuel flow in response to a reduction in flow rate within the closed system, which would otherwise cause recycling of fuel through the nozzle and back to its source.

3 Claims, 5 Drawing Figures

10
11
12
13
14
16
17
18
21
22
23
24
26
27
28
29
31
32
33
34
36
37
38
39
42
43
44
46
67
88
111
114
3

SEALABLE FUEL DISPENSING NOZZLE WITH AUTOMATIC LOW-FLOW SHUT-OFF MECHANISM

BACKGROUND OF THE INVENTION

In response to the requirements of both government and industry, means have been provided to avoid the passage of volatile fumes to the atmosphere. The problem is particularly severe during the transfer of a volatile fuel or liquid from a storage tank, to a fuel tank or the like.

The system adapted to this purpose when applied to an automotive service station, is ordinarily referred to as a closed fuel system. In essence, the system comprises the basic means whereby to effect a safe, non-polluting fuel transfer operation. A manually operated nozzle is initially inserted into the fuel tank to be filled. Sealing means carried on the nozzle is positioned to form a vapor tight fit with the tank filler tube.

During the actual fuel transfer, fumes which evaporate from the fuel, as well as fumes and air which are displaced from the tank, are carried back through the nozzle. They are then returned to the fuel source or to an alternate accumulation point.

Seal tight nozzles of this type are found to be satisfactory in most instances for effecting the necessary transfer of fuel, as well as for automatically discontinuing fuel flow when the tank becomes filled. However, since the system is entirely segregated and sealed from the atmosphere, there exists a chance for an undesired accumulation of vapors. This occurs when the latter are not properly conducted from the tank being filled.

To overcome the situation which might arise due to a closed system becoming overpressurized, means is usually provided in the fuel dispensing nozzle for discontinuing the flow in response to a predetermined increase in fuel tank pressure. It has been noted, however, that in such systems, because of the particular design of the nozzle, and the facility therein for handling both liquid fuel and vapors, under certain circumstances fuel which is pumped from the source can be recycled through the nozzle. It thereafter returns to the source without ever entering the fuel tank being filled. This circumstance represents an untenable situation. Although the pumped volume of fuel is registered, it nonetheless might not reach its destination.

The factors which lead toward recycling of the fuel are often prompted by some malfunction in the fuel pumping mechanism. This malfunction can originate at any of several elements within the system prior to fuel reaching the nozzle. In any instance, a characteristic of the malfunction is that the fuel pressure, within the system, and within the nozzle itself, decreases noticeably. Further, the flow rate of fuel passing through the system is lessened.

Toward overcoming the problem of fuel recycling, there is presently disclosed a nozzle and means therein for automatically discontinuing fuel flow. This latter action is taken in response to a predetermined pressure decrease or reduction in flow rate at the upstream side of the nozzle's main metering valve.

The hereinafter described system comprises basically the necessary measuring or sensing means for monitoring the closed circuit to detect a number of conditions. These conditions are reflected in the pressure, or degree of vacuum established at various points within one nozzle. The condition at the sensing point is then transmitted to a main valve operator. The latter is preset, through the effect of biasing springs, to be set into motion in response to the reception of a predetermined sensed condition.

It is therefore an object of the invention to provide a fuel dispensing nozzle capable of sensing a decrease in fuel flow volume, and of discontinuing flow through the nozzle. A further object is to provide a seal tight nozzle for a fuel system which is adapted to automatically adjust itself to discontinue fuel flow therethrough in response to a number of conditions within the system prompted either by overpressuring or underpressuring of the latter. A still further object is to provide a dispensing system for a volatile fuel in which a malfunction in the system, which would ordinarily prompt recycling of the fuel back to its source, is automatically stabilized by sensing of the condition within the dispensing nozzle.

DESCRIPTION OF THE DRAWINGS

Referring to FIG. 1, a nozzle 10 of the type contemplated is shown in a closed fuel system which is comprised primarily of a source of fuel 11 which is connected to a pump 12. The latter in turn can be actuated to deliver fuel through a conduit 13, through the nozzle 10, and thence to the fuel tank 14 such as is found in an automobile or a boat. The nozzle 10 as shown, is removably positioned in filler pipe 16 of the tank 14 and includes means 17 for providing a vapor tight seal with the latter to complete the closed fuel system.

This system is characteristic of the normal service station wherein an automotive vehicle will be driven to the pump 12 and so positioned to receive the nozzle 10. As is generally done, the nozzle is manually inserted into place by an operator such that the resilient sealing element 17, a rubber boot or the like forms a desired temporary sealed connection between the nozzle 10 and the tank filler pipe 16.

Figures 1, 2:
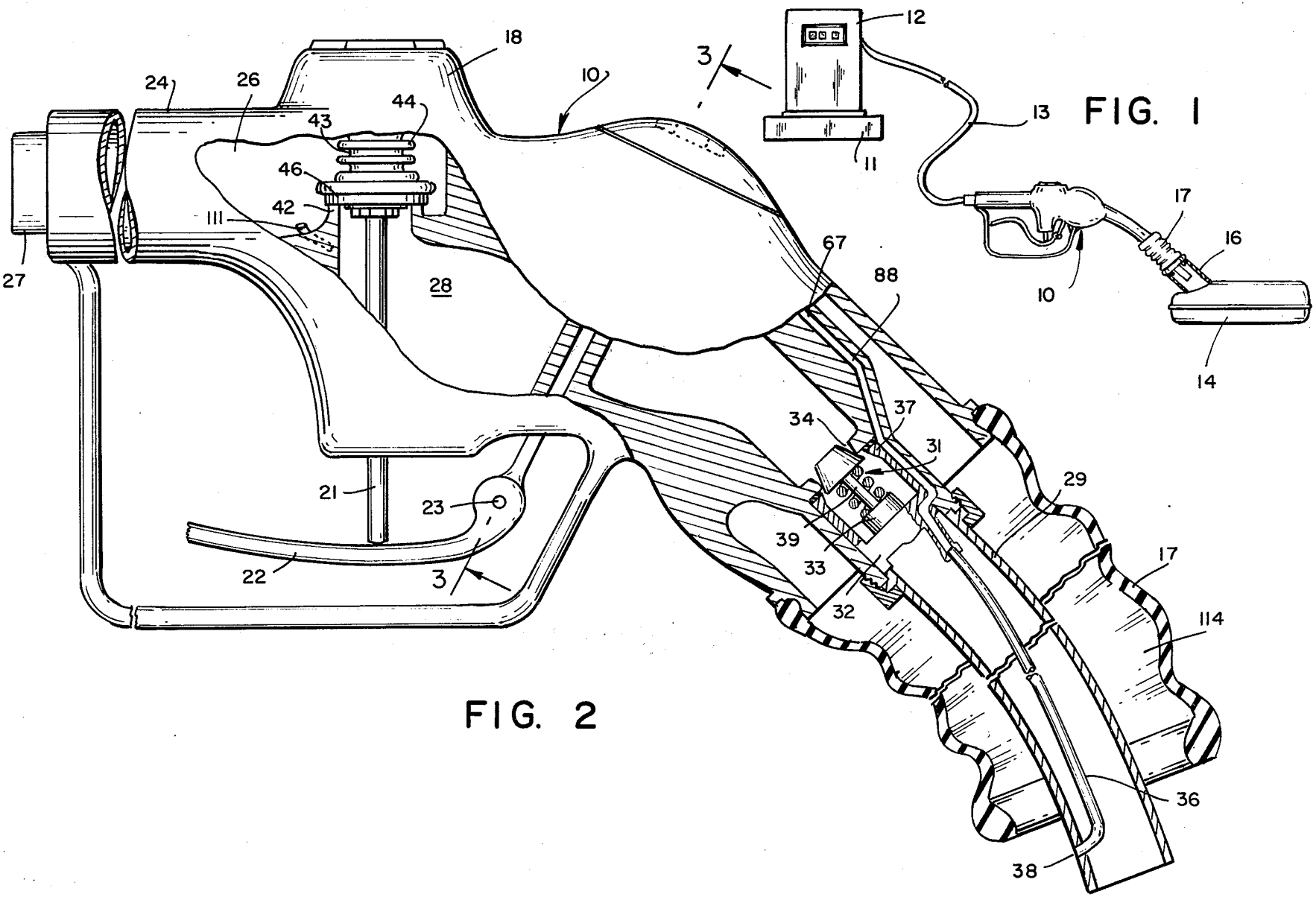
FIG. 1 is an environmental sketch illustrating a closed fuel system.
FIG. 2 is an elevation view in cross section of a nozzle of the type contemplated.

Referring to FIG. 2, nozzle 10 comprises basically a body 18 in which a main flow valve 19 is positioned. The latter is connected through an extended plunger 21 to operably engage a manual actuator lever 22. The latter is pivoted at one end 23, the other end being manually adjustable to achieve a desired fuel flow rate.

Body 18 comprises an elongated handle 24 which encloses the main fuel passage 26, which terminates at the handle remote end at a connection 27. Said connection 27 is adapted to engage elongated, flexible fuel conduit 13 which in turn is communicated at its far end to the fuel source or pump 12.

The downstream side of main control valve 19 opens into a fuel passage 28, which in turn is communicated with elongated discharge tube 29 through check valve 31. The elongated discharge tube 29 as shown, is slightly curved to more readily facilitate the fuel transfer operation and to preferably dispose the nozzle in an efficient attitude for achieving the necessary fuel transfer.

Fuel passage 28 formed within nozzle 10 is provided with a central portion having check valve 31 disposed therein. The latter comprises in essence a check valve base 32 supported between the peripheral walls of the circular passage 30. Base 32 includes an upstanding guide column 33 disposed substantially longitudinally of the flow passage 30. A check valve aperture 34 is formed within said passage 28, by annular seat 37. Check valve 31 further includes a circular frusto conical segment having a circumferential edge which sealably engages seat 37 when urged into the latter by a biasing spring 39. The latter is positioned along a guide column 33, further engaging the base member 32 to permit oscillatory motion of the check valve. Such valve motion normally occurs in response to the movement or flow of fuel through main control valve 19 and into the downstream passage 28 and 30 and into spout 29 prior to fuel entering fuel tank 14.

Main valve 19 as shown, includes essentially a circular seat 42 against which a plunger 43 is urged by a biasing spring 44. Plunger 43 includes a circular sealing face 46 which corresponds to seat 42. An elongated extension pin or stem 21 depends from valve plunger 43 and terminates externally of the body 18 to be contacted by actuating lever 22. Main valve 19 is adjusted to open position by pivotally moving actuator lever 22 such that it raises valve stem 21. Thus, discharge tube 29 is provided internally with a sensing tube 36 which includes a vent opening 38 at the lower end thereof. Said tube is communicated with passage 41, which in turn is communicated through passage 67 with chamber 68 of main flow valve 19 operator. Operationally, so long as fuel is flowing through tube 29, the valve operator will be undisturbed. However, as fuel rises in filler pipe 16 it will eventually cover vent opening 38 to establish a vacuum control signal.

Figure 3:
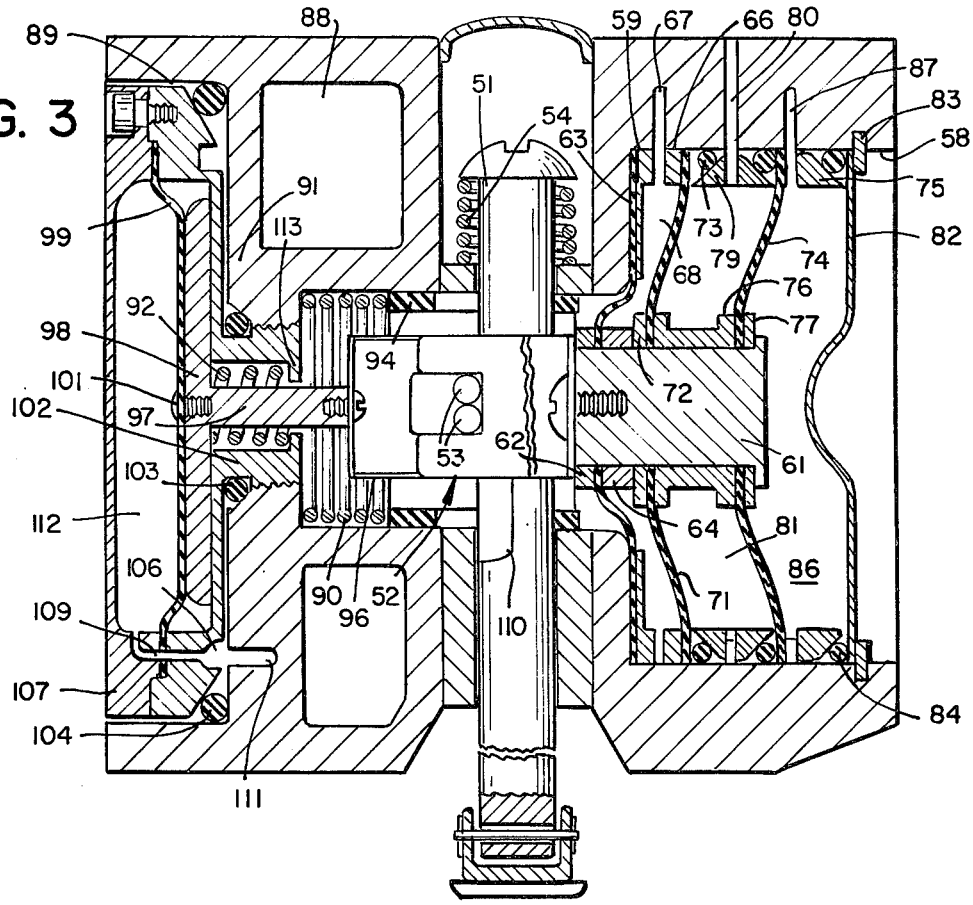
FIGS. 3 and 4 are cross-sectional views, on an enlarged scale taken along line 3—3 of FIG. 2.
Figure 4:
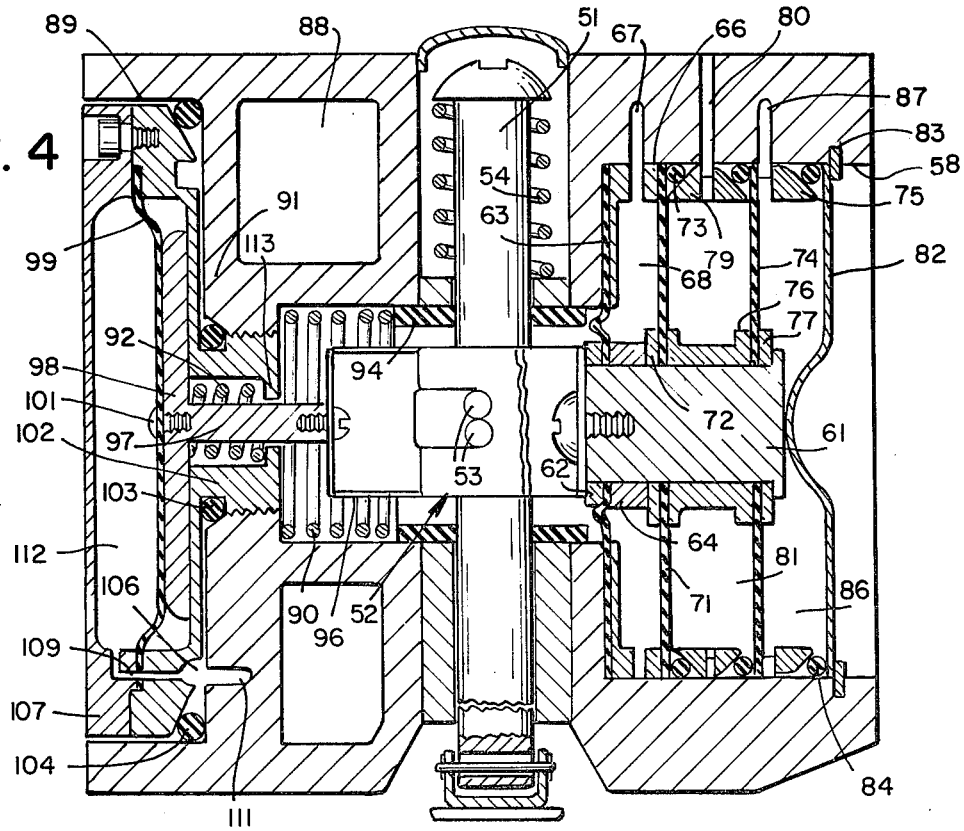

Referring to FIGS. 3 and 4, the main valve 19 operator assembly embodies the basic functions of a concept that is utilized in the prior art.

As presently shown, a lock-out plunger 51 is laterally notched along one side to receive a locking carriage assembly shown generally at 52. Said carriage assembly supports one or more antifriction locking pins or rollers 53 arranged to slidably engage the lock-out plunger notch. Such engagement will serve to maintain the lock-out plunger in an upward or withdrawn position. This position is assumed at such time as main flow valve 19 is urged to the open position. Thus, lock-out plunger 51 is drawn in a downward direction against spring 54 thereby urging valve plunger 21 upward and permitting fuel flow through valve 19. The shown arrangement permits the entire locking mechanism, including the various diaphragms to be hereinafter described, to be conveniently located within nozzle body 18, and to be readily accessible for replacement, repair or the like.

Operator assembly 52 includes, together with lock-out plunger 51, a plurality of diaphragms which are arranged parallel and spaced apart to form a plurality of intermediate chambers communicated with various sections of the fuel and vapor flow passage. Functionally, the respective diaphragms by a predetermined degree of movement, actuate rollers 53 depending from the locking carriage 52, to permit instantaneous spring biased movement of lock-out plunger 51. This occurs at such time as a particular condition is achieved in one of the pressure sensitive diaphragm chambers. The particular condition is thus transmitted to the chamber as a signal in the form of a pressure change received from a discrete part of the fuel and vapor flow passage.

Each opposed side of nozzle body 18 is provided with a laterally protruding hub 56 and 57, which are aligned one with the other along a common axis. Further, said axis is disposed substantially normal to the longitudinal axis of lock-out plunger 51.

An elongated cavity formed within the two protruding hubs 56 and 57, houses the respective pressure sensing diaphragms as well as connecting linkages 52 and 96. Said diaphragms form a series of resilient adjacent walls and define the respective expandable chambers therebetween.

Referring to FIGS. 3 and 4, cavity 58 includes an inwardly extending circular shoulder 59 which defines a central opening through which the carriage assembly 94 is operably retained. This retention is such as to allow a sliding lost motion movement of one of the linkage elements 52 and 96 in response to movement of one of the diaphragms. The connecting linkages 52 and 96 embody a degree of free horizontal movement between them.

The laterally extending linkage member 61 includes a peripheral shoulder 62 against which a sealing diaphragm 63 is closely held by a retaining ring 64. The outer periphery of diaphragm 63 is forcibly urged against the shoulder 59 by a positioning ring 66. The latter is provided with sufficient openings to permit access therethrough to passage 67. The latter communicates with check valve 31 to transmit the pressure condition at the latter along said passage to chamber 68.

A second diaphragm 71 is connected at its center to connecting linkage element 61 by means of a positioning collar 72 which forms a fluid tight seal about the diaphragm inner surface. The periphery of said diaphragm 71 is urged into engagement with positioning ring 66 by a resilient member 73 to define chamber 68.

A third diaphragm 74 is positioned on the connector element 61 by a locking ring 76, which is retained within a peripheral shoulder of snap ring 77. Thus, each of the respective diaphragms, 63, 71 and 74, are maintained fixedly at their inner edges in a constant spaced relationship.

The periphery of diaphragm 71 is urged into engagement with a further resilient sealing ring 73 which in turn contacts a conically contoured ring 79 having peripheral openings, such that both positioning rings 73 and 79 are deformed thereby providing the necessary fluid tight seal between the respective diaphragms 71 and 74 which define the internal chamber 81.

Chamber 81 is communicated with the atmosphere by a vent opening 80. A cover plate 82 is held within the cavity 58 by a snap ring 83 or similar fastening member positioned within a peripheral groove of the cavity. Said cover plate 82 is provided with protruding section to abut member 61.

Sealing ring 84 at the periphery of cover plate 82 serves to form an expandable chamber 86 intermediate said plate 82 and diaphragm 74. Passage 87 communicates said chamber 86 through contoured ring 75 having peripheral openings with vapor return line 88. Thus, the vapor pressure within tank 14 is reflected by way of passage 88, in chamber 86.

The oposite side of the body 18 is provided as noted with a cavity 89 in alignment with the cavity 58. Said cavity 89 includes an inwardly protruding shoulder 91, together with an inner undercut cavity 92 within which a biasing spring 93 is retained. Said spring 93 is positioned to engage the radial shoulder 113 of body 18 and bottom of piston element 98 to normally urge the latter in a direction away from lock-out plunger 51.

The second connecting linkage element 96 is slidably retained within cavity 87, having been longitudinally extended by plunger 97 to which piston 98 depends. The latter forms a base for diaphragm 99 which is fastened to the head of piston 98 by a positioning screw 101.

An insert 102 is threadably positioned in place against seal ring 103 and 104 thereby isolating the confined passage 106. A cover 107 is fixed into place against insert 102 having the periphery of diaphragm 99 therebetween.

A transverse passage 109 communicates passage 111 with chamber 112 defined between cover 107 and diaphragm 99. Said passage 111 is formed into body 18, exiting at passage 26 upstream of valve 19. Thus, chamber 112 is exposed to fuel pressure within the nozzle which acts against diaphragm 99 to compression spring 113. Such action urges the locking pins 53 into engagement with lock-out plunger 51 so long as the normal fuel flow through the nozzle does not decrease. However, in the event of a decrease in said fuel flow, or a reduction in fuel pressure, the pressure in chamber 112 will be relaxed. Spring 113 wil then displace linkage member 96 such that the locking rollers 53 will withdraw from engagement with lockout plunger 51.

Since the condition sensed at passage 111 is contingent on the volume flow of fuel through passage 26, as well as on supply pressure. This passage is preferably located immediately adjacent to and upstream of seat 42 of valve 19.

Operationally, with nozzle 10 registered in tank 14 filler tube 16, resilient boot 17 will engage the filler pipe upper entrance lip to close the entire fuel system to the atmosphere. Vapor from the system will then be forced from the tank 14 to enter annulus 114 and be directed through the nozzle 10 to an accumulation tank or reservior not presently shown.

Fuel flow through nozzle 10 is initiated by manually displacing and locking lever 22 in an upward position, depending on the rate of fuel to be transferred. Plunger 51 is restrained by rollers 53 of carriage 94 which are urged by spring 90 into the lateral groove 110 of plunger 51. In such position the plunger will be maintained stationary, and free of oscillatory movement.

Rollers 53 can be pulled out of lateral groove 110 of plunger 51 by element 96. Rollers 53 can also be urged out of lateral groove 110 of plunger 51 by means of member 52 independent of member 96. Member 96 can also operate independent of member 52. Such a structure is characteristic of a lost motion linkage.

With plunger 51 locked, valve stem or plunger 21 will be raised to unseat valve 19, and start fuel flow through the nozzle. At this point, the respective diaphragms will assume the position approximately shown in FIG. 3. This presumes that pump pressure is adequate to permit the nozzle to operate. Fuel flow will then continue until such time as the lock-out plunger 51 is released and permitted to drop against the urging of spring 54 by spring 44.

More particularly, fuel pressure behind diaphragm 99 in cavity 112 will urge element 97 against the resisting force of spring 93, toward lock-out plunger 51. Diaphragm 99 at this point will be subject to the fluid pressure in passage 26 by virtue of passages 111 and 109 which are communicated with chamber 112.

SHUT-OFF AT FILL

In the course of the filling operation fuel will eventually rise within filler tube pipe 16 to a point where it covers vent 38 thereby preventing further vapor flow therethrough. The resulting reduced pressure in chamber 68 caused by the pressure condition at check valve 31, will cause diaphragm 71 to collapse into chamber 68. Diaphragm 71 will thereby urge linkage member 61 toward lock-out plunger 51. In so doing, 61 will override its corresponding element 96 of the lost motion linkage to displace rollers 53 from the lock-out plunger 51 groove 110.

SHUT-OFF AT OVERPRESSURE

As fuel flows from nozzle 10 into tank 14, entering liquid will displace any fumes from within the tank. These fumes, including both air and vaporized fuel, will be forced upwardly through filler pipe 16 into annulus 14, and thence through the nozzle 10 to a storage means. As mentioned, while not specifically shown in the present figures, these vapors will pass through passage 88 and thence be conducted through body 18 to conduit 13 or to a separate conduit for conveying the vapors.

In the instance when the pressure within the system inadvertently builds up to a predetermined level considered dangerous, the nozzle will automatically shut off, or discontinue flow. This is achieved through actuation of the main valve 19 as follows.

Figure 5:
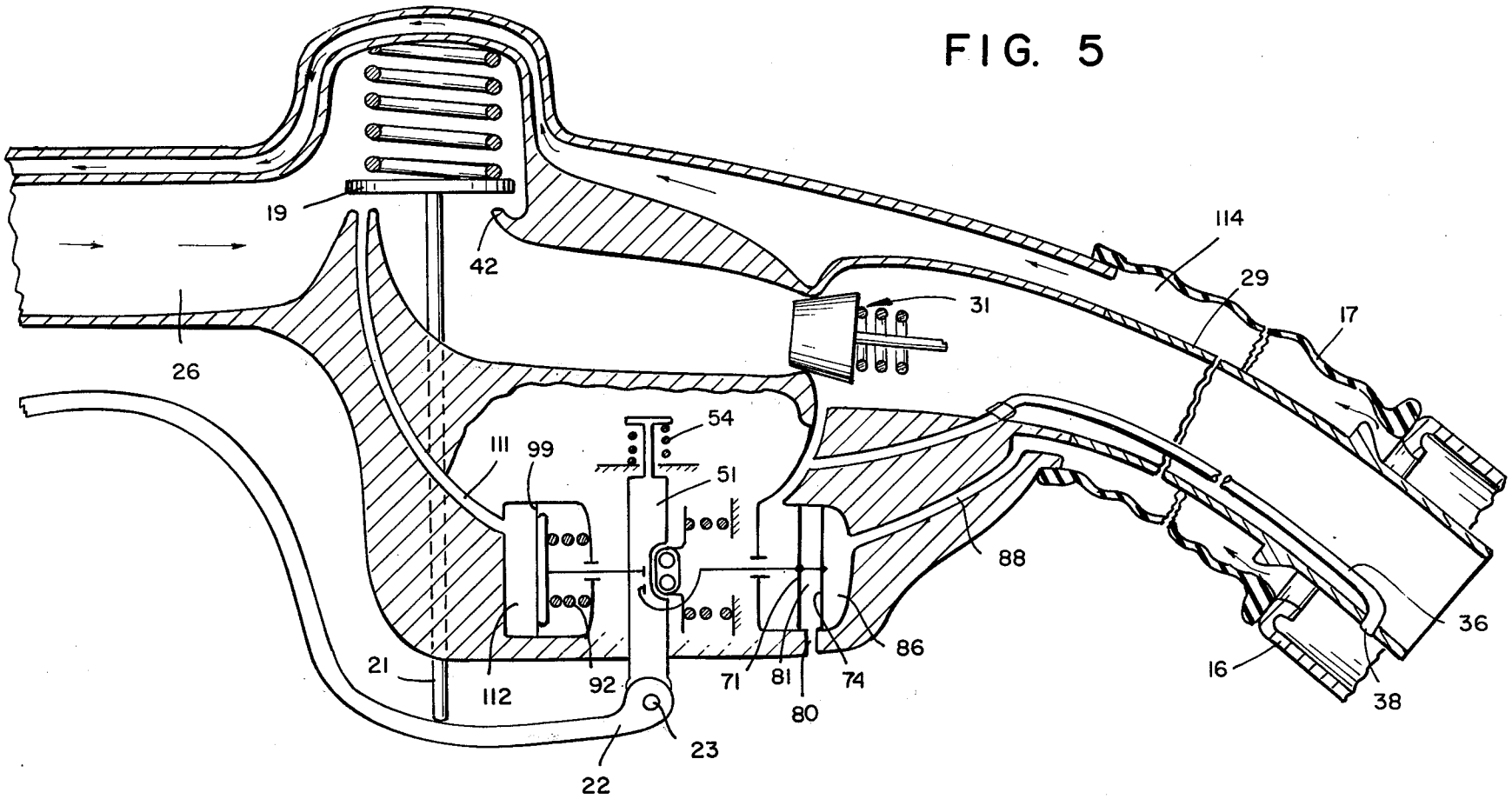
FIG. 5 is similar to FIG. 1, having a portion thereof broken away to illustrate schematically the nozzle's mechanism.

Referring to FIG. 5, as the vapors are received in passage 114 they are then directed into passage 88 and thence conducted into chamber 86. Positioning of diaphragm 74 in chamber 86 is determined by the force of spring 90 which acts against the outwardly protruding shoulder of carriage 94. Thus while as shown in FIG. 4, the linkage element 61 is maintained in a retracted position by the cover plate 82. As the pressure within chamber 86 rises due to a stoppage in vapor flow anywhere in the system, diaphragm 74 will be urged into the vented chamber 81. This displaces locking rollers 53 and consequently releases lock-out plunger 51.

SHUT DOWN AT LOW FLOW

At such time as a malfunction within the fuel system, including pump 12, nozzle 10, or the conduit 13 causes a slow down in the flow rate, or a drop off of pressure in fuel pressure, the system will automatically be shut down by virtue of main flow valve 19 closing. This is achieved at least in part by monitoring of the condition immediately upstream of main valve 19, and preferably adjacent to seat 42.

Referring to FIG. 5, the instant pressure sensing means includes passage 111 which opens into passage 26 at a point immediately upstream of valve 19. The pressure sensed at this point in the fuel stream is transmitted through nozzle passage 11, by way of passage 109, to communicate with chamber 112. As herein mentioned, during normal operation when fuel is flowing through the nozzle 10 at normal conditions, linkage elements 97 will be depressed against the pressure of spring 113, thereby maintaining rollers 53 with groove 110. This will maintain lock-out plunger 51 in its position to maintain valve 19 open.

When the pressure in passage 26, or the flow rate of fuel therethrough decreases below a predetermined desired level, the reduced pressure transmitted to chamber 112 will cause diaphragm 99 to collapse into chamber 112. Plunger 97 will thereby be displaced by spring 113 such that connecting link element 96 draws away from lock-out plunger 51. This action will withdraw the rollers 53 from lock-out plunger groove 110 to again release the plunger and allowing spring 44 to close valve 19. It will return to its upward position under pressure of spring 54 after valve closure, ready for a new cycle of operation.

It is seen that in any of the instances above noted when a condition within the nozzle causes the lock-out plunger 51 to be released, this will be achieved even though any of the other conditions within the nozzle remain normal. More specifically, the instant low flow shut-off mechanism which functions in response to reduction in pressure, will be achieved even though the fuel has not risen within the tank filler pipe 16, and even though the vapors within the system have not achieved an undesirably high level.

Other modifications and variations of the invention as hereinbefore set forth may be made without departing from the spirit and scope thereof, and therefore, only such limitations should be imposed as are indicated in the appended claims.

I claim:

1. In a closed system adapted to carry a volatile fuel said system including a hand actuated dispensing nozzle operable to sealably engage a fuel tank (14) to be filled, and being further operable to automatically discontinue fuel flow therethrough in response to either an overpressuring of the fuel system beyond a predetermined pressure, or to the inadvertent decrease in pressure within the liquid portion of the fuel system, said nozzle including an elongated body (24) having a fuel passage (26) extending therethrough which is communicated to a source of said volatile fuel, a discharge tube (29) adapted to sealably register in said fuel tank, a flow control valve (19) positioned in said fuel passage, a flow control valve operator (21), an actuator lever (22) engaging said valve operator (21) and said flow control valve (19) respectively and being displaceable to adjust said flow control valve (19) to an open position to initiate fuel flow through the nozzle, means depending from said elongated body (24) defining a passage for vapors which leave said fuel tank (14) when said discharge tube (29) is sealably positioned in the latter for a fuel transfer operation.

said flow control valve operator (21) including a stem (51) having locking means (53) engaged therewith to releasably retain said stem (51) in a retracted position during a period of fuel flow through the nozzle, said locking means (53) being disengageable to release said stem (51) in response to a predetemined fuel pressure condition whereby to allow said flow control valve (19) to close, means forming a plurality of pressure sensitive chambers (68, 81, 86, 112) being axially aligned transversely of said elongated body (24) and being operably engaged through linkage means with said stem locking means (53), at least one of said plurality of pressure sensitive chambers (112) being disposed to one side of said stem (51), and including means forming a cavity in said elongated body (24), a diaphragm (99) disposed across said cavity to thereby form said closed chamber (112), and passage means (111) communicating said closed chamber (112) with said fuel passage (26), the latter having an inlet opening into said fuel passage (26) at a point upstream of said flow control valve (19), whereby said pressure sensitive chamber (112) will sense the pressure in said fuel passage (26) and in response to a predetermined decrease in said fuel pressure to a predetermined lower value, will thereby cause said diaphragm (99) to be displaced into said closed chamber (112) thereby to cause said valve (19) to close and discontinue fuel flow into said fuel tank.

2. In a system as defined in claim 1, wherein said respective pressure sensitive chambers are aligned normal to the longitudinal axis of said stem.

3. In a system as defined in claim 1, wherein the respective diaphragms disposed to one side of said stem are fixed to a first member of said linkage, the diaphragms disposed to the other side of said stem are connected to a second member of said linkage, the respective first and second linkage members being independently movable to release said stem locking means.

* * * * *